US010465678B2

(12) United States Patent
Wrobel et al.

(10) Patent No.: US 10,465,678 B2
(45) Date of Patent: Nov. 5, 2019

(54) FLUID PUMP LEAKAGE DIVERSION

(71) Applicant: Graco Minnesota Inc., Minneapolis, MN (US)

(72) Inventors: Steve J. Wrobel, Rogers, MN (US); Justin G. Johnston, Rogers, MN (US); Christopher A. Lins, Waverly, MN (US); Brian M. Mulgrew, St. Francis, MN (US)

(73) Assignee: Graco Minnesota, Minneapolis, MN (US)

( * ) Notice: Subject to any disclaimer, the term of this patent is extended or adjusted under 35 U.S.C. 154(b) by 237 days.

(21) Appl. No.: 15/423,706

(22) Filed: Feb. 3, 2017

(65) Prior Publication Data

US 2017/0227001 A1 Aug. 10, 2017

Related U.S. Application Data

(60) Provisional application No. 62/292,047, filed on Feb. 5, 2016.

(51) Int. Cl.
*F04B 53/04* (2006.01)
*F04B 9/04* (2006.01)
(Continued)

(52) U.S. Cl.
CPC ..... *F04B 53/04* (2013.01); *F04B 1/0448* (2013.01); *F04B 9/04* (2013.01); *F04B 15/02* (2013.01);
(Continued)

(58) Field of Classification Search
USPC ..... 92/86
See application file for complete search history.

(56) References Cited

U.S. PATENT DOCUMENTS 3,011,808 A 12/1961 Tucker et al.
3,290,047 A 12/1966 Mayer
(Continued)

FOREIGN PATENT DOCUMENTS

CN 204746676 U 11/2015
DE 202006006221 U1 7/2006
WO WO8600119 A1 1/1986

OTHER PUBLICATIONS

Extended European Search Report for EP Application No. 17154599.9, dated Jun. 16, 2017, 8 Pages.
(Continued)

*Primary Examiner* — Michael Leslie
*Assistant Examiner* — Daniel S Collins
(74) *Attorney, Agent, or Firm* — Kinney & Mange, P.A.

(57) ABSTRACT

A piston rod assembly includes a piston rod having a first end configured to contact fluid, a packing retainer through which the piston rod extends, and one or more packing rings. The packing retainer includes one or more leakage ports forming passageways between an inner surface and an outer surface of the packing retainer. The one or more packing rings surround the piston rod, are adjacent the inner surface of the packing retainer, and are positioned between the one or more leakage ports and a bottom end of the packing retainer. The one or more leakage ports are positioned so that fluid that leaks past the one or more packing rings will flow through the one or more leakage ports.

28 Claims, 6 Drawing Sheets

(51) Int. Cl.

| | |
|---|---|
| ***F04B 19/22*** | (2006.01) |
| ***F04B 53/02*** | (2006.01) |
| ***F04B 53/14*** | (2006.01) |
| ***F04B 1/04*** | (2006.01) |
| ***F04B 15/02*** | (2006.01) |
| ***F04B 53/16*** | (2006.01) |
| *B05B 9/04* | (2006.01) |

(52) U.S. Cl.
CPC ..... *F04B 19/22* (2013.01); *F04B 53/02* (2013.01); *F04B 53/143* (2013.01); *F04B 53/144* (2013.01); *F04B 53/164* (2013.01); *B05B 9/0413* (2013.01)

(56) References Cited

U.S. PATENT DOCUMENTS

| | | | | |
|---|---|---|---|---|
| 3,307,574 | A | 3/1967 | Anderson | |
| 3,776,558 | A | 12/1973 | Maurer et al. | |
| 4,177,998 | A | 12/1979 | Laitkep et al. | |
| 4,178,133 | A * | 12/1979 | Rawicki | F04B 43/107 277/320 |
| 4,886,241 | A | 12/1989 | Davis et al. | |
| 4,972,867 | A | 11/1990 | Ruesch | |
| 5,056,757 | A | 10/1991 | Wood | |
| 5,415,531 | A | 5/1995 | Cavanaugh | |
| 5,593,166 | A | 1/1997 | Lovell et al. | |
| 5,755,372 | A * | 5/1998 | Cimbura, Sr. | E21B 33/08 277/318 |
| 6,752,067 | B1 | 6/2004 | Davidson et al. | |
| 8,074,999 | B2 | 12/2011 | Burdick et al. | |
| 8,136,792 | B2 | 3/2012 | King | |
| 8,177,524 | B1 * | 5/2012 | Kieffer | F04B 17/03 417/360 |

OTHER PUBLICATIONS

Graco Inc., GX Electric Airless Sprayers, 3A3212C, Feb. 2016, 54 pages.
Graco Inc., The Basics of Airless Spraying, 321132G, Sep. 2016, 24 pages.
First Chinese Office Action for CN Application No. 2017100634674, dated Aug. 24, 2018, 22 Pages.

* cited by examiner

FLUID PUMP LEAKAGE DIVERSION

CROSS-REFERENCE TO RELATED APPLICATION(S)

This application claims the benefit of U.S. Provisional Application No. 62/292,047 filed Feb. 5, 2016 for "FLUID PUMP LEAKAGE DIVERSION," which is fully incorporated by reference herein.

BACKGROUND

The present disclosure relates generally to fluid dispensing systems, and in particular, to a piston pump assembly for fluid dispensing systems.

Fluid dispensing systems may be used to spray materials such as paint onto a desired surface. Fluid dispensing systems such as paint sprayers often include pump assemblies to move the paint through the system from a reservoir to a spray gun. A piston pump assembly may include a piston rod assembly having a piston rod within a packing retainer.

During pumping operation, paint within the piston pump assembly may squeeze into the packing retainer and leak further up the piston rod. In that case, leaking paint can progress up the piston rod until it reaches the critical drive mechanisms of the paint sprayer, such as the gearing and the motor. Such leaking paint can cause damage to the critical drive mechanisms, which can result in a non-functional sprayer. Therefore, a piston pump assembly that simplifies identification of a paint leak and prevents leaking paint from coming into contact with and damaging the critical drive mechanisms of the paint sprayer is needed.

SUMMARY

A piston rod assembly includes a piston rod having a first end configured to contact fluid, a packing retainer through which the piston rod extends, and one or more packing rings. The packing retainer includes one or more leakage ports forming passageways between an inner surface and an outer surface of the packing retainer. The one or more packing rings surround the piston rod, are adjacent the inner surface of the packing retainer, and are positioned between the one or more leakage ports and a bottom end of the packing retainer. The one or more leakage ports are positioned so that fluid that leaks past the one or more packing rings will flow through the one or more leakage ports.

A method for controlling leakage of fluid along a piston rod stem of a piston pump assembly includes directing fluid that has leaked past one or more packing rings in a packing retainer from an inner end of a leakage port in the packing retainer to an outer end of the leakage port, the leakage port being located between the one or more packing rings and a top end of the packing retainer, guiding the fluid from the outer end of the leakage port to an inner end of a leakage outlet in a pump housing, and directing the fluid from an inner end of the leakage outlet in the pump housing to an outer end of the leakage outlet, which is positioned so that the fluid will flow down a visible outer surface of the pump housing.

DETAILED DESCRIPTION

In general, the present disclosure describes a piston pump assembly that uses leakage ports and leakage outlets to control the leakage of paint along a piston rod stem of the piston pump assembly so as not to affect the operation of or cause damage to critical drive mechanisms of a paint sprayer. The paint that exits the leakage outlets acts as a visual indicator of when the piston pump assembly is in need of maintenance. As a result of the controlled leakage and visual indication, less expensive components of the piston pump assembly may be replaced before other more expensive components of the paint sprayer become damaged and also require replacement.

Figure 1:
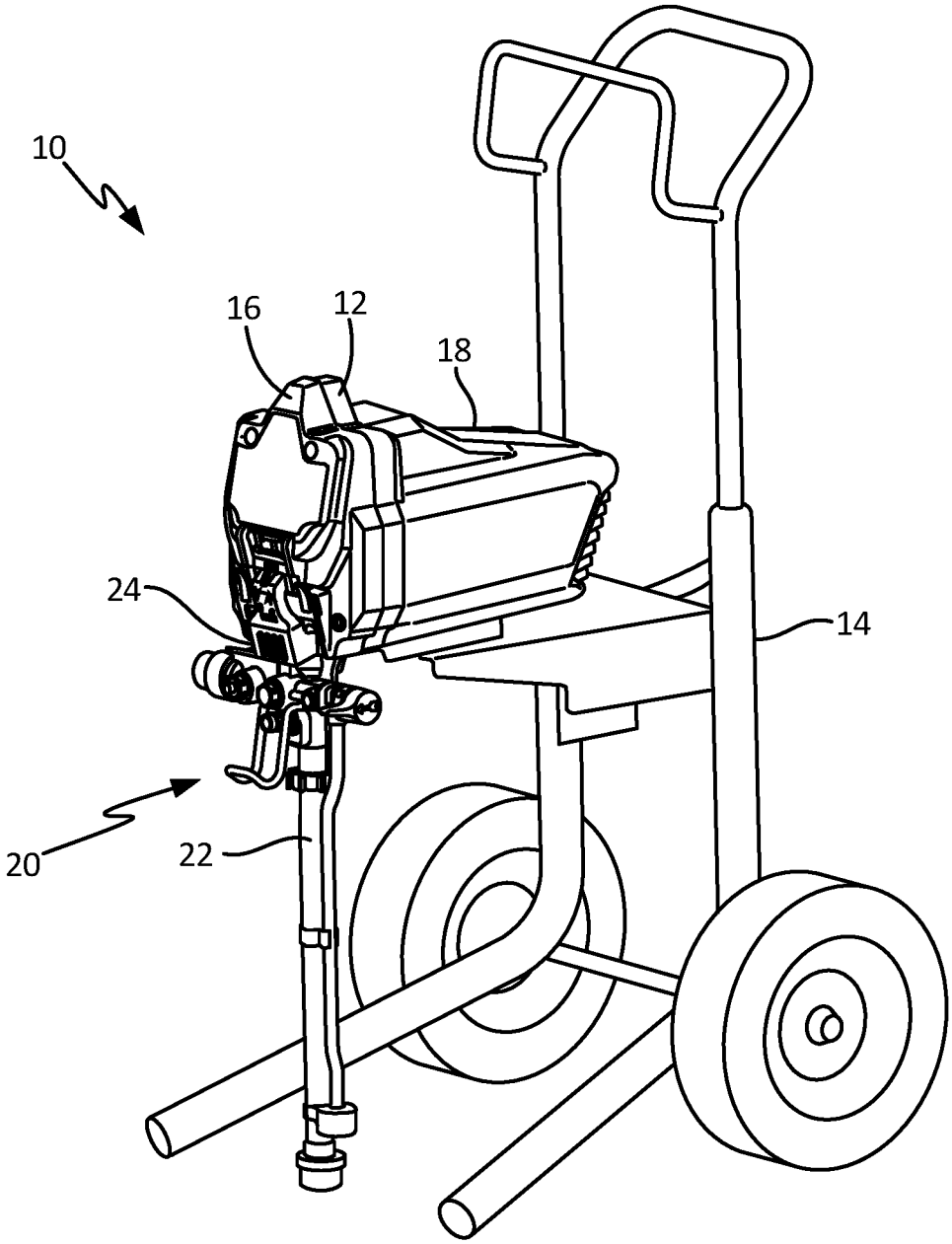
FIG. 1 is a perspective view of a sprayer with a door in a closed position covering portions of a piston pump assembly of the sprayer.

FIG. 1 is a perspective view of sprayer 10, which includes end bell 12, frame 14, front cover 16, motor housing 18, piston pump assembly 20, and intake hose 22. Front cover 16 includes door 24, which is in a closed position to cover portions of piston pump assembly 20 of sprayer 10.

End bell 12 is mounted on frame 14. Front cover 16 is attached to a front side of end bell 12 and motor housing 18 is attached to a back side of end bell 12. Front cover 16 can be secured to the front side of end bell 12 with a plurality of screws that extend through front cover 16 and screw into end bell 12. Piston pump assembly 20 can be mounted to a front side of end bell 12. Intake hose 22 is attached to a bottom end of piston pump assembly 20. Door 24 is movably attached to a bottom end of front cover 16. In alternate embodiments, front cover 16 may not include door 24. In such embodiments, front cover 16 extends over the area where door 24 would have been located.

End bell 12 acts as a structural element to support front cover 16 and motor housing 18 on frame 14. Front cover 16 partially contains, covers, supports, and/or protects various components of sprayer 10. Motor housing 18 contains an electric motor (not shown) to drive piston pump assembly 20. End bell 12 also supports piston pump assembly 20. Piston pump assembly 20 causes intake hose 22 to suck paint out of a reservoir and deliver it to piston pump assembly 20. The paint is further directed out of piston pump assembly 20 through a hose (not shown) to a gun assembly (not shown) for spraying on a desired surface.

Figure 2:
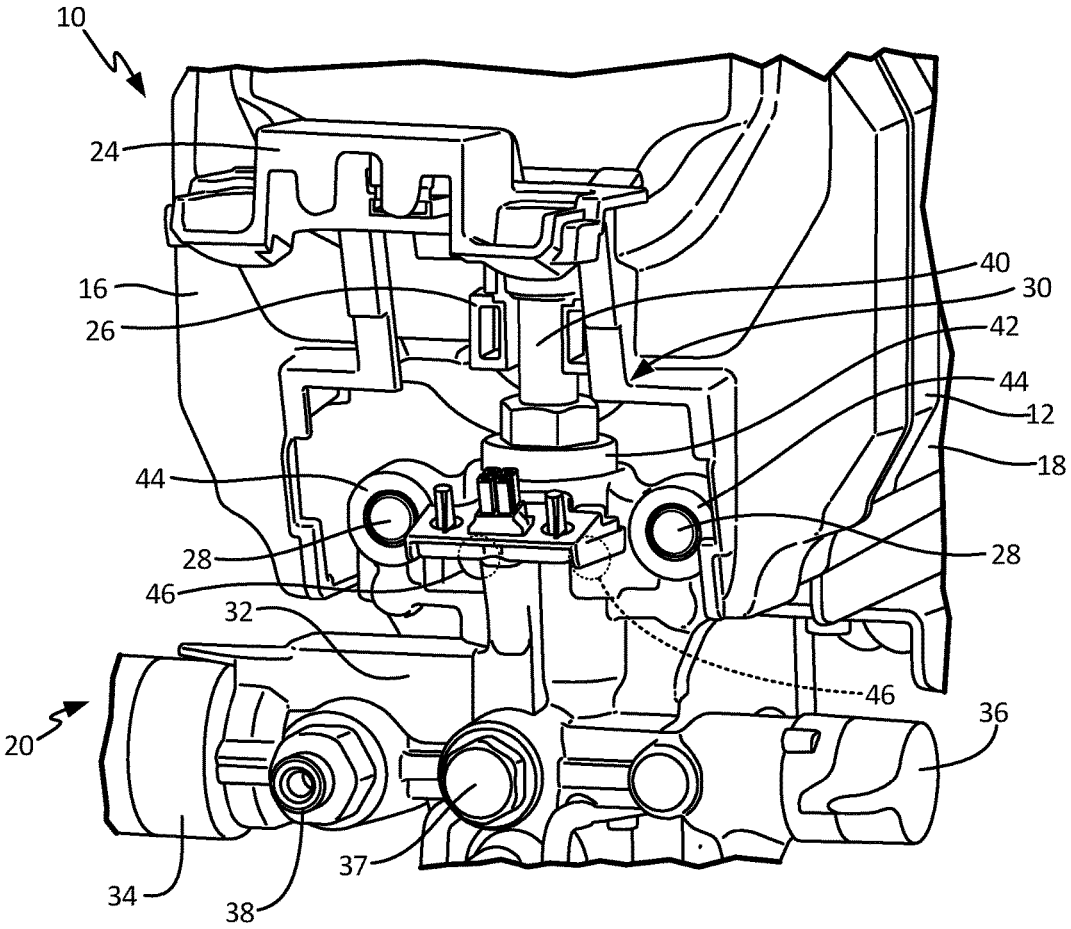
FIG. 2 is an enlarged partial perspective view of the sprayer with the door in an open position showing the piston pump assembly mounted on an end bell.
Figure 3:
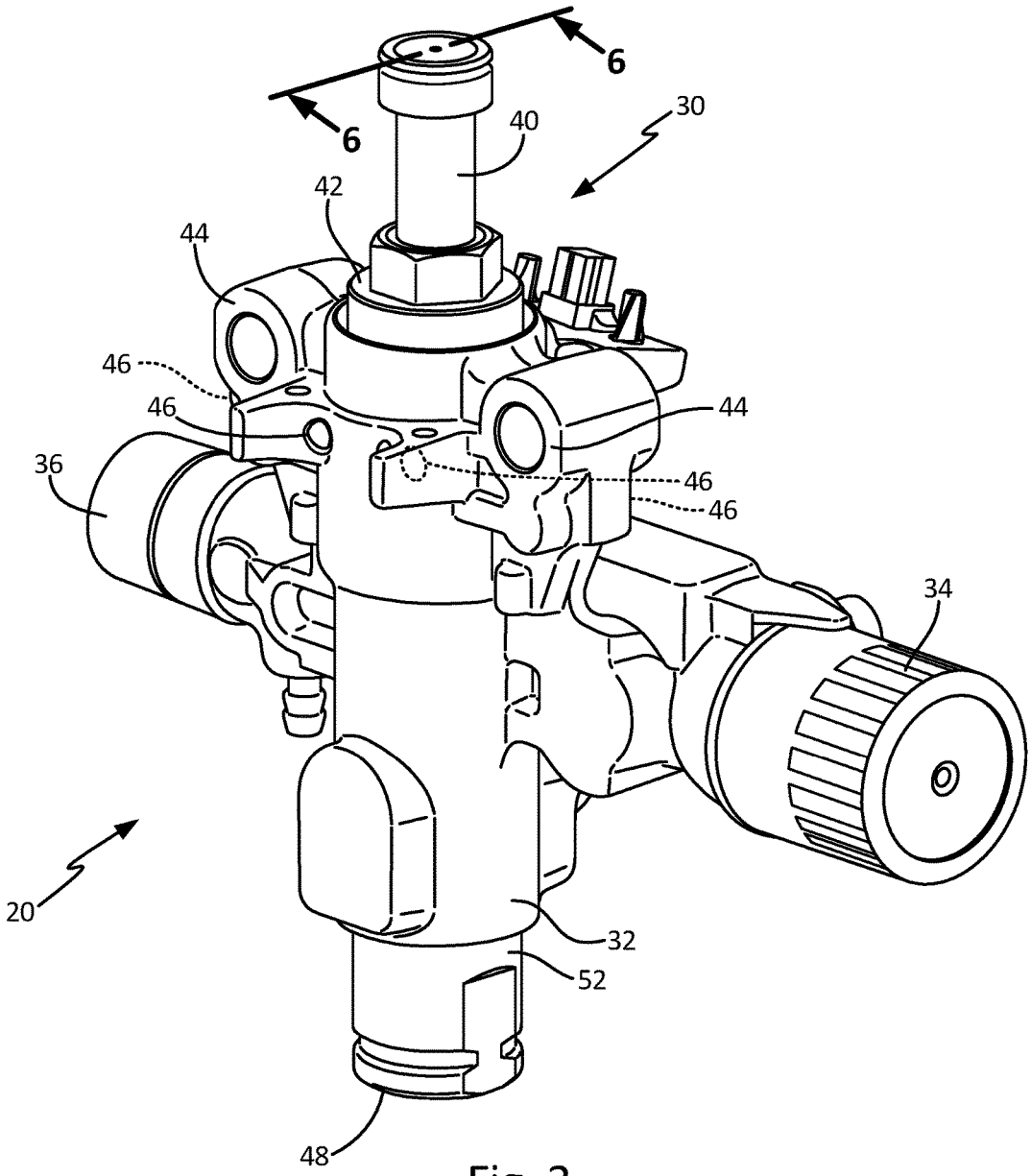
FIG. 3 is a perspective view of a back side of the piston pump assembly dismounted from the end bell.
Figure 4:
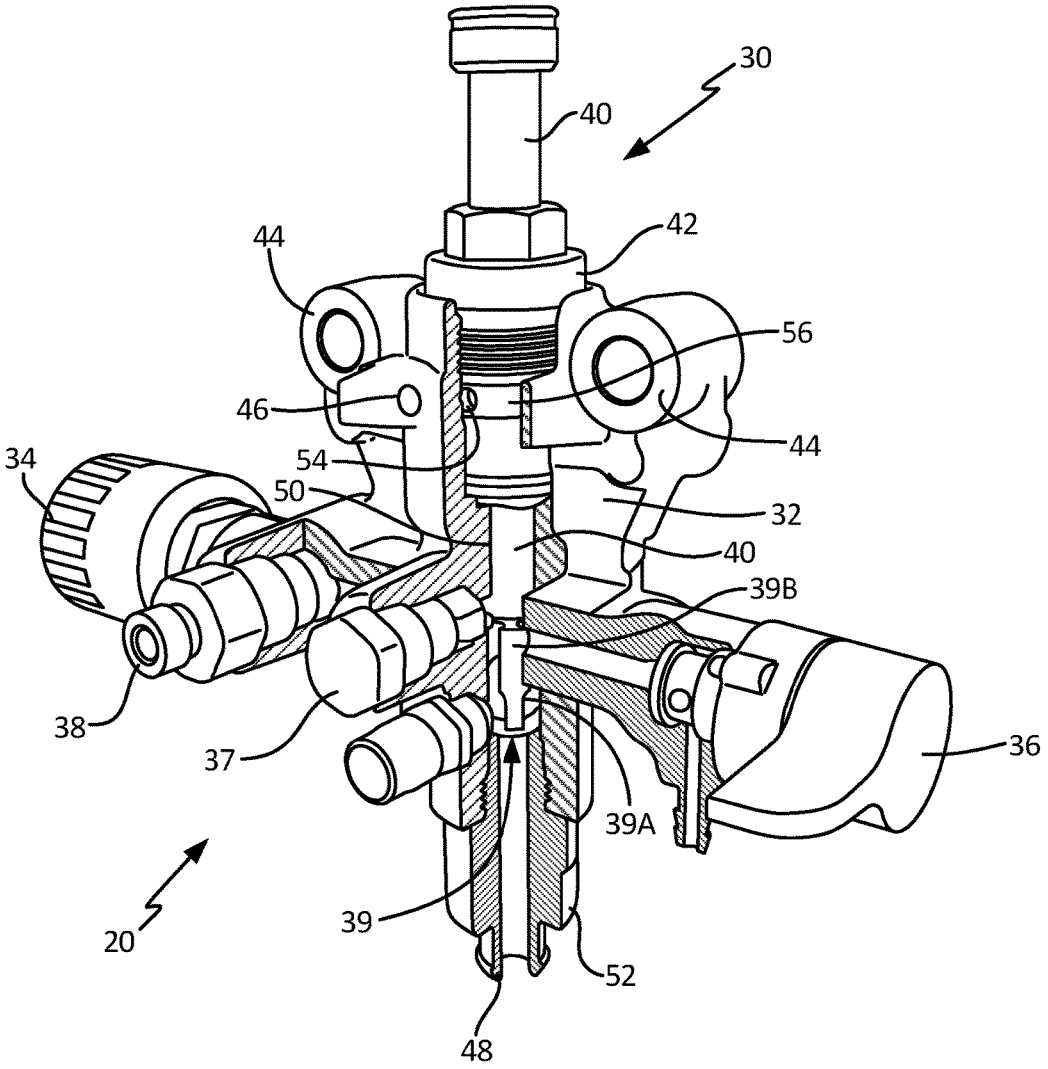
FIG. 4 is a cut-away view of a front side of the piston pump assembly showing inside the pump housing.
Figure 5:
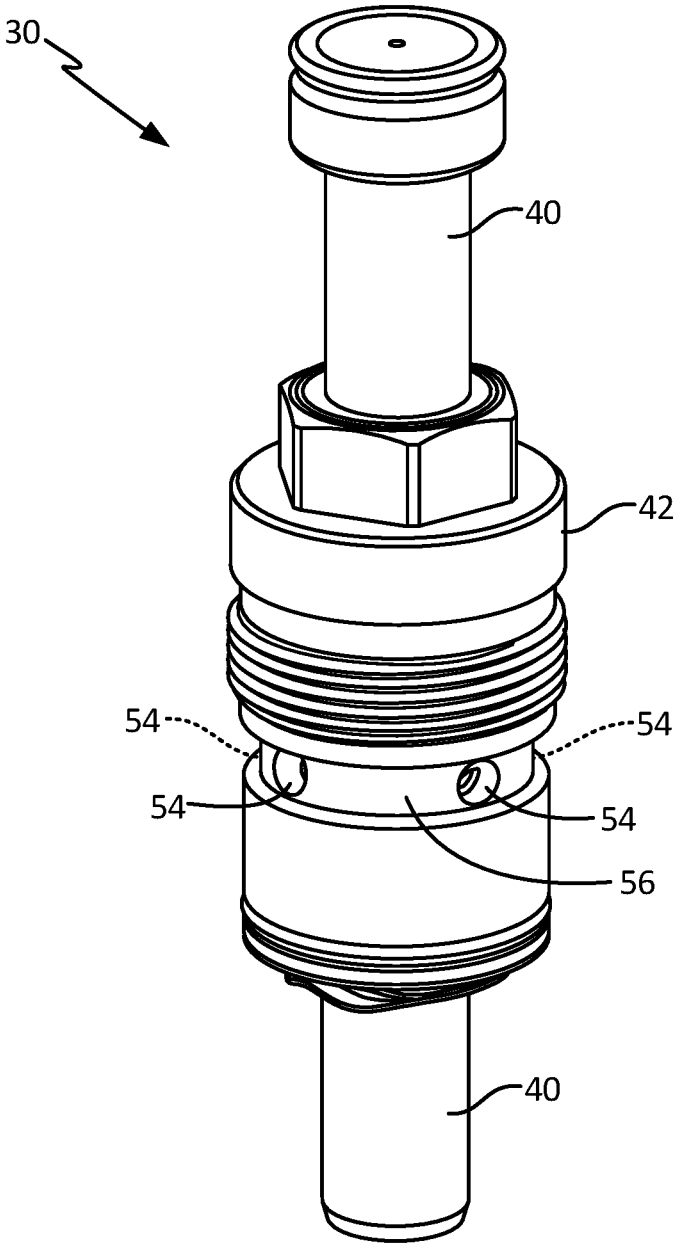
FIG. 5 is a perspective view of a piston rod assembly showing a piston rod and a packing retainer.

FIG. 2 is an enlarged partial perspective view of sprayer 10 with door 24 in an open position showing piston pump assembly 20 mounted on end bell 12. FIG. 3 is a perspective view of a back side of piston pump assembly 20 dismounted from end bell 12. FIG. 4 is a cut-away view of a front side of piston pump assembly 20 showing inside pump housing 32. FIG. 5 is a perspective view of piston rod assembly 30 showing piston rod 40 and packing retainer 42. FIGS. 2-5 will be discussed together. Sprayer 10 includes end bell 12 (shown in FIG. 2), front cover 16 (shown in FIG. 2), motor housing 18 (shown in FIG. 2), piston pump assembly 20, and yoke 26 (shown in FIG. 2). Front cover 16 includes door 24 (shown in FIG. 2). End bell 12 includes pins 28 (shown in FIG. 2). Piston pump assembly 20 includes piston rod assembly 30, pump housing 32, pressure control 34, prime control 36, outlet check valve 37 (shown in FIGS. 2 and 4), output port 38 (shown in FIGS. 2 and 4), and inlet check valve 39 (shown in FIG. 4). Piston rod assembly 30 includes piston rod 40 and packing retainer 42. Pump housing 32 includes receivers 44, leakage outlets 46, intake port 48 (shown in FIGS. 3 and 4), pumping chamber 50 (shown in FIG. 4), and intake housing 52 (shown in FIGS. 3 and 4). Inlet check valve 39 includes ball 39A (shown in FIG. 4) and ball guide 39B (shown in FIG. 4). Packing retainer 42 includes leakage ports 54 (shown in FIGS. 4 and 5) and channel 56 (shown in FIGS. 4 and 5).

Sprayer 10 has end bell 12 with front cover 16 attached to a front side of end bell 12 and motor housing 18 attached to a back side of end bell 12. A top of piston pump assembly 20 can be mounted to a front side of end bell 12 near the bottom of end bell 12. The top of piston pump assembly 20 is mounted to the front side of end bell 12 interior to front cover 16. Door 24 is movably attached to a bottom end of front cover 16 near the top of piston pump assembly 20. Yoke 26 is also connected to the front side of end bell 12 interior to front cover 16. First ends of pins 28 are connected to the front side of end bell 12 near the bottom of end bell 12 such that they are cantilevered from end bell 12. Pins 28 are connected to end bell 12 below yoke 26 and interior to door 24 of front cover 16. Pins 28 may be unitary parts of end bell 12 or fixed to end bell 12. Pins 28 are not mechanically supported by front cover 16. Pins 28 may be formed from metal.

Piston pump assembly 20 has piston rod assembly 30 where a bottom end of piston rod assembly 30 is surrounded by pump housing 32. A bottom end of piston rod assembly 30 extends into a top of pump housing 32. Piston rod assembly 30 is at least partially contained within pump housing 32. Pressure control 34 is attached to a first side of pump housing 32 and prime control 36 is attached to a second side of pump housing 32. In alternate embodiments, piston pump assembly 20 does not include pressure control 34 or prime control 36 or both pressure control 34 and prime control 36. Outlet check valve 37 is located at a front side of pump housing 32 positioned between pressure control 34 and prime control 36. Output port 38 is located at the front side of pump housing 32 positioned between pressure control 34 and outlet check valve 37. Output port 38 is the exterior terminus of a lateral passageway within pump housing 32. Inlet check valve 39 is located within pump housing 32.

Piston rod assembly 30 has piston rod 40 surrounded by packing retainer 42. A bottom end of piston rod 40 extends fully through a cavity of packing retainer 42 and into a top of pump housing 32, where it can contact paint within pump housing 32. A top end of piston rod 40 is insertable into yoke 26. Piston rod 40 can be made of metal, such as stainless steel. Packing retainer 42 surrounds piston rod 40 and a bottom end of packing retainer 42 extends into the top of pump housing 32. An inner surface of packing retainer 42 forms the cavity of packing retainer 42 within which piston rod 40 reciprocates. An exterior of packing retainer 42 is a circumferential outer surface of packing retainer 42. The exterior of packing retainer 42 includes threading that can interface with interior threading of pump housing 32 such that packing retainer 42 can thread into pump housing 32 and can be secured to pump housing 32. The top end of packing retainer 42 has a hex feature to facilitate tool-assisted removal of packing retainer 42 from pump housing 32. Packing retainer 42 may also be referred to as a packing nut.

Pump housing 32 has receivers 44, which are apertures, at a top of pump housing 32. More specifically, the apertures of receivers 44 extend entirely through pump housing 32. In alternate embodiments, the apertures of receivers 44 may extend only partially through pump housing 32. Receivers 44 may be apertures of a size and shape that correspond with the size and shape of pins 28. A first receiver 44 is at a first side of pump housing 32 and a second receiver 44 is at a second side of pump housing 32. Leakage outlets 46 are apertures that extend laterally through pump housing 32 from an inner surface of pump housing 32 to an outer surface of pump housing 32. Leakage outlets 46 are located in pump housing 32 below the top of pump housing 32. A first leakage outlet 46 is at a first side of a front side of pump housing 32 and a second leakage outlet 46 is at a second side of the front side of pump housing 32. A third leakage outlet 46 is at the first side of a back side of pump housing 32 and a fourth leakage outlet 46 is at the second side of the back side of pump housing 32. Four leakage outlets 46 are shown, but pump housing 32 may have any number of leakage outlets 46 including a single leakage outlet 46 in alternate embodiments. Intake port 48 is an opening at a bottom end of pump housing 32. Intake port 48 opens into pumping chamber 50. Pumping chamber 50 is an interior chamber or cylindrical cavity formed by the interior surface of pump housing 32. Pumping chamber 50 accepts a bottom end of piston rod 40. Pumping chamber 50 is in fluid communication with output port 38. The bottom end of pump housing 32 is intake housing 52. Pump housing 32 can be formed from aluminum, steel, or any other suitable metal. Inlet check valve 39 has ball 39A and ball guide 39B positioned in pumping chamber 50 of pump housing 32 near a bottom of pumping chamber 50 and above intake housing 52.

Packing retainer 42 has leakage ports 54 positioned around a circumference of packing retainer 42. Leakage ports 54 are apertures that extend laterally through packing retainer 42 from an inner surface of packing retainer 42 to an outer surface of packing retainer 42. As such, leakage ports 54 fluidly connect the interior or cavity of packing retainer 42 to the exterior or outer circumferential surface of packing retainer 42. Leakage ports 54 are located between a top end of packing retainer 42 and a bottom end of packing retainer 42. Additionally, leakage ports 54 are interior to pump housing 32 when packing retainer 42 is threaded into pump housing 32. A first leakage port 54 is at a first side of a front side of packing retainer 42 and a second leakage port 54 is at a second side of the front side of packing retainer 42. A third leakage port 54 is at the first side of a back side of packing retainer 42 and a fourth leakage port 54 is at the second side of the back side of packing retainer 42. Four leakage ports 54 are shown, but packing retainer 42 may have any number of leakage ports 54 in alternate embodiments, including a single leakage port 54. Leakage ports 54 are evenly arrayed about the circumference of packing retainer 42, the four leakage ports 54 being arranged every 90 degrees. However, in alternate embodiments leakage ports 54 may not be evenly arrayed. Leakage ports 54 are positioned such that they are in fluid communication with leakage outlets 46. Channel 56 is a circumferential channel positioned to fluidly connect leakage ports 54 with leakage outlets 46. Channel 56 is a recess formed in the outer surface of packing retainer 42. Channel 56 may be semi-annular or fully annular. An upper edge of channel 56 is above leakage ports 54 and a lower edge of channel 56 is below leakage ports 54. When channel 56 is formed in packing retainer 42, channel 56 is aligned with leakage outlet 46 or a lateral passageway leading to output port 38. In alternate embodiments, packing retainer 42 does not include channel 56. Further, in alternate embodiments, channel 56 may be a recess formed in the inner surface in pump housing 32 (shown in FIG. 6) that fluidly connects leakage ports 54 with leakage outlets 46, output port 38, or the passageway leading to output port 38. As such, when channel 56 is formed in pump housing 32, channel 56 is aligned with leakage ports 54. Additionally, packing retainer 42 and pump housing 32 may both include channels 56 to fluidly connect leakage outlets 46 and leakage ports 54. Packing retainer 42 can be formed from metal, such as brass.

Threading receivers 44 onto pins 28, such that pins 28 are received within receivers 44, can mount piston pump assembly 20 to pins 28 and therefore to a front side of end bell 12. In order to mount piston pump assembly 20 to end bell 12, a top of piston rod 40 must be inserted into yoke 26. Likewise, removing receivers 44 from pins 28 and piston rod 40 from yoke 26 can dismount piston pump assembly 20 from end bell 12. Sliding motion can remove receivers 44 from pins 28 and disengage piston rod 40 from yoke 26 to separate piston pump assembly 20 from end bell 12. Door 24 is movable from a closed position (as shown in FIG. 1) to an open position (as shown in FIG. 2). Door 24 opens by a sliding-pivoting action. By moving door 24 to an open position, piston pump assembly 20 may be mounted to or dismounted from end bell 12 without removing front cover 16. The opening of door 24 exposes various mechanical and electrical components of sprayer 10. Piston pump assembly 20 may be dismounted from end bell 12 for sprayer 10, and particularly piston pump assembly 20, to be serviced for maintenance.

Pump housing 32 supports pressure control 34 and prime control 36. Pressure control 34 controls pressure regulation of piston pump assembly 20 and prime control 36 controls priming of piston pump assembly 20. Pressure control 34 can be an electrically driven control containing a sensor that is sensitive to the generated paint pressure, a user input for setting the paint pressure such as a rotating knob connected to a potentiometer, and a circuit for closed loop pressure regulation based on the sensor and the setting of the user input. The circuit may control the electric motor (not shown) to regulate pressure, such as by switching the motor on and off.

Piston pump assembly 20 is mounted to end bell 12 for sprayer 10 to spray paint. Pump housing 32 can function as a manifold for paint flow. When piston rod 40 is engaged with yoke 26, piston rod 40 is driven by drive mechanisms of sprayer 10 to reciprocate within the cavity of packing retainer 42 and pumping chamber 50 of pump housing 32. The reciprocating movement of piston rod 40 between downward and upward directions draws paint from a reservoir (not shown) into piston pump assembly 20 through intake hose 22 and forces paint out of piston pump assembly 20 through output port 38. Intake port 48 connects with intake hose 22 to provide a passageway to bring paint into pump housing 32 through intake housing 52. The paint is pulled up into pumping chamber 50 where it interacts with inlet check valve 39. Ball 39A, a seat, and ball guide 39B of inlet check valve 39 allow paint to flow in only one direction, which is a generally upward direction according to the orientation shown in FIG. 4. Piston rod 40 moves upward in an upstroke phase of the reciprocation cycle to pull paint through inlet check valve 39 and further up pumping chamber 50. Piston rod 40 moves downward in a downstroke phase of the reciprocation cycle to push paint from pumping chamber 50 through the lateral passageway within pump housing 32 and outlet check valve 37 to output port 38. FIG. 4 shows piston rod 40 in the downstroke phase of the reciprocation cycle. A first end of a hose (not shown) can connect with output port 38 and a second end of the hose can connect with a spray gun assembly (not shown) to dispense paint onto a desired surface.

Leakage ports 54 form passageways between an inner surface of packing retainer 42 and an outer surface of packing retainer 42. As such, leakage ports 54 provide passageways for leaking paint to travel from the inner surface of packing retainer 42 to the outer surface of packing retainer 42. Leakage ports 54 empty directly into channel 56 at the outer surface of packing retainer 42. Thus, once at the outer surface of packing retainer 42, paint can travel along channel 56 to leakage outlets 46. Leakage outlets 46 form passageways between an inner surface of pump housing 32 and an outer surface of pump housing 32. As such, leakage outlets 46 provide passageways for paint to move from the inner surface or interior of pump housing 32 to the outer surface or exterior of pump housing 32 before it reaches the top of pump housing 32. In this embodiment, leakage ports 54 are aligned with leakage outlets 46 such that paint can travel directly from leakage ports 54 to leakage outlets 46 and need not travel along channel 56. In such embodiments, packing retainer 42 and pump housing 32 may not include channel 56. In alternate embodiments, leakage ports 54 are not aligned with leakage outlets 46 and paint travels along channel 56 in packing retainer 42 to reach leakage outlets 46. In another embodiment, leakage ports 54 are not aligned with leakage outlets 46 and paint travels along channel 56A (shown in FIG. 6) in pump housing 32 to reach leakage outlets 46.

Paint can leak within pump housing 32 and seep along piston rod 40 into packing retainer 42 due to pressure from the reciprocating or pumping action of piston rod 40 within pump housing 32. For example, paint can be forced or squeezed between the inner surface of packing retainer 42 and an exterior surface of piston rod 40. The leaking paint may seep along piston rod 40 and out of the top of piston pump assembly 20 until it reaches the internal mechanical components of sprayer 10 behind front cover 16. Such leaking paint dries on the mechanical parts of sprayer 10 and interferes with the mechanical operation of sprayer 10. Moreover, such leakage may be hidden by front cover 16 and door 24 such that a user cannot readily see the paint interfering with the mechanical components. Leakage ports 54 allow paint to exit packing retainer 42 at a side of packing retainer 42 and limit the extent to which paint can seep along piston rod 40. Specifically, paint that has leaked or squeezed into packing retainer 42 can be forced or squeezed from the inner surface of packing retainer 42 through leakage ports 54. Thus, paint is expelled out of a side of packing retainer 42 rather than forced out the top end of packing retainer 42 where it can come into contact with and damage the drive mechanisms of sprayer 10. Leaking paint can then travel along channel 56 until it reaches leakage outlets 46 in pump housing 32. At leakage outlets 46, paint is forced from an inner surface of pump housing 32 to an outer surface of pump housing 32.

As a result, leaking paint escapes pump housing 32 through leakage outlets 46 at the side of pump housing 32 and flows down the outer surface of pump housing 32. As such, leakage outlets 46 inhibit the escape of paint through the top of piston pump assembly 20 by providing passageways for leaking paint to exit the interior of pump housing 32 at a side of pump housing 32 before reaching the top of pump housing 32. Thus, less paint travels out of the top end of packing retainer 42 to the drive mechanisms of sprayer 10, causing less damage to the drive mechanisms of sprayer 10. As a result, leakage outlets 46 prevent paint from leaking into the end bell 12 (shown in FIG. 1) and motor housing 18 (shown in FIG. 1) of sprayer 10 and interfering with the mechanical function of the drive mechanisms of sprayer 10. Further, because leakage outlets 46 cause leaking paint to flow down the outer surface or exterior of pump housing 32, leakage outlets 46 provide a visual indicator, paint on the outer surface of pump housing 32, that paint is leaking. As such, the piston pump assembly 20 may be serviced before the leaking paint seeps into the internal drive mechanisms of sprayer 10 and causes damage.

Figure 6:
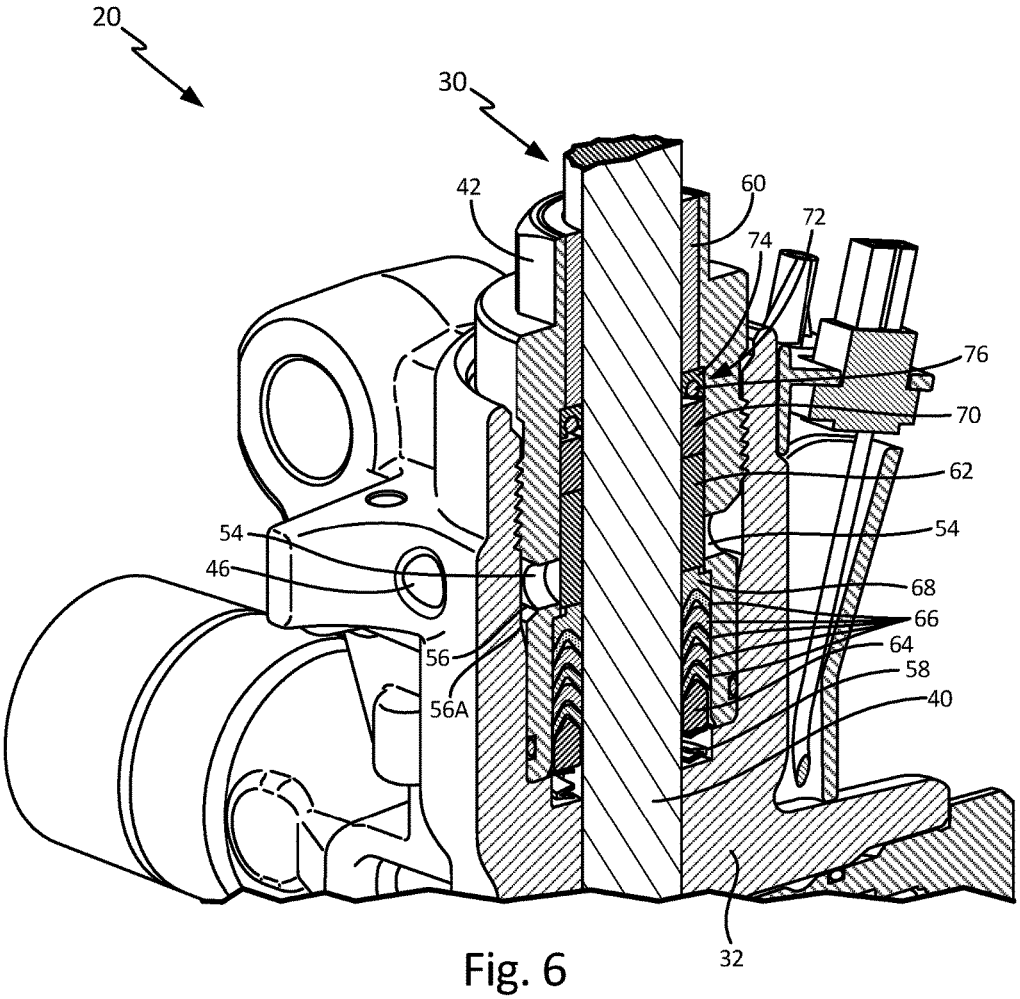
FIG. 6 is an enlarged partial cross-sectional view of the piston pump assembly taken along line 6-6 of FIG. 3.

FIG. 6 is an enlarged partial cross-sectional view of piston pump assembly 20 taken along line 6-6 of FIG. 3. Piston pump assembly 20 includes piston rod assembly 30 and pump housing 32. Piston rod assembly 30 includes piston rod 40, packing retainer 42 and spring 58. Pump housing 32 includes leakage outlet 46 and channel 56A. Packing retainer 42 includes leakage ports 54 and channel 56. Positioned within packing retainer 42 are bushing 60, felt ring 62, first gland 64, packing rings 66, second gland 68, retainer 70, and wiper seal 72. Wiper seal 72 includes U-shaped element 74, and O-ring 76.

Piston pump assembly 20 has piston rod assembly 30 surrounded by pump housing 32. A bottom end of piston rod assembly 30 extends into a top of pump housing 32. Piston rod assembly 30 has piston rod 40 surrounded by packing retainer 42. A bottom end of piston rod 40 extends through a cavity of packing retainer 42 and the top of pump housing 32 into pumping chamber 50 of pump housing 32. Packing retainer 42 surrounds piston rod 40 and a bottom end of packing retainer 42 extends into the top of pump housing 32. Spring 58 is located adjacent an inner surface of pump housing 32 and a bottom end of packing retainer 42.

Pump housing 32 has leakage outlet 46 located in pump housing 32. Leakage outlet 46 is an aperture that extends laterally through pump housing 32 from an inner surface of pump housing 32 to an outer surface of pump housing 32. Leakage outlet 46 is located in a side of pump housing 32 below the top of pump housing 32. Pump housing 32 may have any number of leakage outlets 46 in alternate embodiments. Channel 56A is a recess formed in an inner surface of pump housing 32.

Packing retainer 42 has leakage ports 54 between a top end of packing retainer 42 and a bottom end of packing retainer 42. Leakage ports 54 are apertures that extend laterally through packing retainer 42 from an inner surface of packing retainer 42 to an outer surface of packing retainer 42. FIG. 6 shows two leakage ports 54, but packing retainer 42 may have any number of leakage ports 54 in alternate embodiments. Packing retainer 42 has circumferential channel 56, which is a recess formed in the outer surface of packing retainer 42. An upper edge of channel 56 is above leakage ports 54 and a lower edge of channel 56 is below leakage ports 54. Channel 56 is positioned to fluidly connect leakage ports 54 with leakage outlet 46. Channel 56 may be semi-annular or fully annular. In alternate embodiments, packing retainer 42 does not include channel 56.

Channel 56A is aligned with leakage ports 54 in packing retainer 42. Channel 56A is also aligned with channel 56 in packing retainer 42 such that channel 56A is in fluid communication with channel 56. Channel 56A is positioned to fluidly connect leakage ports 54 with leakage outlet 46. Channel 56A may be semi-annular or fully annular. Alternatively, channel 56A may fluidly connect leakage ports 54 with output port 38 or the passageway in pump housing 32 leading to output port 38. In alternate embodiments, pump housing 32 does not include channel 56A.

Packing retainer 42 has annular bushing 60 positioned at a top end of packing retainer 42 adjacent an inner surface of packing retainer 42. Bushing 60 surrounds piston rod 40. Bushing 60 can be made of metal. In alternate embodiments, packing retainer 42 does not include bushing 60. Further, in alternate embodiments, bushing 60 is positioned in a different location in packing retainer 42.

Packing retainer 42 has felt ring 62 surrounding piston rod 40 and positioned adjacent an inner surface of packing retainer 42 at leakage ports 54. As such, felt ring 62 is located between piston rod 40 and leakage ports 54. Felt ring 62 is a paint permeable annular ring and may be the only paint permeable component contained within packing retainer 42. Felt ring 62 is formed of felt or other stranded material. Additionally, felt ring 62 may be oil-soaked. Felt ring 62 may be a lubrication ring that lubricates piston rod 40. Felt ring 62 may include lateral holes adjacent the first port. In alternate embodiments, packing retainer 42 does not include felt ring 62. Further, in alternate embodiments, felt ring 62 is positioned in a different location in packing retainer 42.

Packing retainer 42 has annular first gland 64 at a bottom end of packing retainer 42 adjacent an inner surface of packing retainer 42 and surrounding piston rod 40. First gland 64 has a male profile. First gland 64 can be formed from glass-filled nylon or any other suitable polymer. In alternate embodiments, packing retainer 42 does not include first gland 64. Further, in alternate embodiments, first gland 64 is positioned in a different location in packing retainer 42.

Packing retainer 42 has annular packing rings 66 adjacent an inner surface of packing retainer 42 and surrounding piston rod 40. Packing rings 66 are V-shaped and are stacked on top of one another. A plurality of packing rings form a packing ring stack. A bottom end of a bottom packing ring 66 is adjacent a top end of first gland 64 such that the V-shaped packing ring 66 interfaces with first gland 64. Packing rings 66 can comprise alternating leather and polymer rings. The polymer packing rings 66 may be made of UHMWPE or any other suitable polymer. Packing retainer 42 may have any number of packing rings 66 positioned within it, including a single packing ring 66. In alternate embodiments, packing retainer 42 does not include packing rings 66. Further, in alternate embodiments, packing rings 66 are positioned in a different location in packing retainer 42.

Packing retainer 42 has annular second gland 68 adjacent an inner surface of packing retainer 42 and surrounding piston rod 40. Second gland 68 has a female profile. A bottom end of second gland 68 is adjacent a top end of top packing ring 66 such that second gland 68 interfaces with V-shaped packing ring 66. A top end of second gland 68 is adjacent a bottom end of felt ring 62. Second gland 68 can be formed from brass or any other suitable material. In alternate embodiments, packing retainer 42 does not include second gland 68. Further, in alternate embodiments, second gland 68 is positioned in a different location in packing retainer 42.

Packing retainer 42 has annular retainer 70 adjacent an inner surface of packing retainer 42 and surrounding piston rod 40. A bottom end of retainer 70 is adjacent a top end of felt ring 62. Retainer 70 can be formed from acetal or any other suitable polymer. In alternate embodiments, packing retainer 42 does not include retainer 70. Further, in alternate embodiments, retainer 70 is positioned in a different location in packing retainer 42.

Packing retainer 42 has annular wiper seal 72 adjacent an inner surface of packing retainer 42 and surrounding piston rod 40. A bottom end of wiper seal 72 is adjacent a top end of retainer 70. A top end of wiper seal 72 is adjacent a bottom end of bushing 60. In alternate embodiments, packing retainer 42 does not include wiper seal 72. Further, in alternate embodiments, wiper seal 72 is positioned in a different location in packing retainer 42. Wiper seal is wetted by felt ring 62. Wiper seal 72 has annular U-shaped element 74 surrounding O-ring 76. U-shaped element 74 and O-ring 76 can be formed from polymer, rubber, a combination of rubber and polymer, or any other suitable material.

Piston rod 40 moves up and down relative to packing retainer 42 and bushing 60, felt ring 62, first gland 64, packing rings 66, second gland 68, retainer 70, and wiper seal 72 of packing retainer 42. Bushing 60, felt ring 62, first gland 64, packing rings 66, second gland 68, retainer 70, and wiper seal 72 seal against piston rod 40 to prevent paint from moving between the exterior of piston rod 40 and the inner surfaces of bushing 60, felt ring 62, first gland 64, packing rings 66, second gland 68, retainer 70, and wiper seal 72. Spring 58 maintains compression of bushing 60, felt ring 62, first gland 64, packing rings 66, second gland 68, retainer 70, and wiper seal 72 within packing retainer 42. Packing rings 66 flare laterally under compression to seal with piston rod 40 to facilitate the creation of a vacuum. Packing rings 66 also provide a seal below leakage ports 54. Felt ring 62 allows paint to wick or seep between the strands of felt ring 62 to traverse felt ring 62. If felt ring 62 is oil soaked, paint can soak through felt ring 62 and oil on the strands can inhibit drying of water-based paint. The oil also extends the life of packing rings 66 so that it takes longer for packing rings 66 to wear. Additionally, the oil lubricates wiper seal 72 to extend the life of wiper seal 72 so that it takes longer for wiper seal 72 to wear. If felt ring 62 has lateral holes, paint can flow laterally from an inner side of felt ring 62 to an outer side of felt ring 62 without seeping through the material of felt ring 62. Wiper seal 72 provides an additional seal between the inner surface of packing retainer 42 and an exterior of piston rod 40.

Packing rings 66 and piston rod 40 create a vacuum to suck paint into piston pump assembly 20. Because felt ring 62 is adjacent leakage ports 54, paint that passes through felt ring 62 exits packing retainer 42 through leakage ports 54. As the only paint permeable component in packing retainer 42, felt ring 62 locates the release of paint proximate leakage ports 54 so that most or all of the paint exits through leakage ports 54. Wiper seal 72 prevents paint from seeping further up piston rod 40 past wiper seal 72 and leaking out of the top of packing retainer 42. Instead, wiper seal 72 forces paint out of leakage ports 54 in packing retainer 42. Further, because felt ring 62 lubricates wiper seal 72, wiper seal lasts longer than first gland 64, packing rings 66, and second gland 68 positioned in packing retainer 42 below leakage ports 54. Felt ring 62, first gland 64, packing rings 66, second gland 68, retainer 70, and wiper seal 72 wear during use due to the nature of the reciprocating piston rod 40 and the abrasive material being pumped within piston pump assembly 20, resulting in paint leaking past them over time. Packing rings 66 may experience more wear and be the first to break down, resulting in paint leaking past packing rings 66.

Leakage ports 54 prevent paint from flowing entirely along piston rod 40, exiting the top of packing retainer 42, and coming into contact with the mechanics of the drive mechanism of sprayer 10. Rather, paint is diverted out of packing retainer 42 through leakage ports 54 and out of a side of pump housing 32 through leakage outlet 46 to flow down the outer surface of pump housing 32. Because leakage outlet 46 is remote from the interior of the drive mechanism of sprayer 10, leakage of paint out of leakage outlet 46 does not interfere with operation of sprayer 10. Moreover, leakage of paint out of leakage outlet 46 is visible to users and provides an indication of wear and the need to service piston pump assembly 20, such as by replacing one or more of felt ring 62, first gland 64, packing rings 66, second gland 68, retainer 70, and wiper seal 72 of packing retainer 42. As such, piston pump assembly 20 can be repaired while the rest of sprayer 10, including the gearing and the motor, remains undamaged.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A piston rod assembly that fits within a pump housing, the piston rod assembly comprising:

a piston rod having a first end configured to contact fluid;

a packing retainer though which the piston rod extends, the packing retainer including one or more leakage ports forming passageways between an inner surface and an outer surface of the packing retainer; and one or more packing rings that surround the piston rod, are adjacent the inner surface of the packing retainer, and are positioned between the one or more leakage ports and a bottom end of the packing retainer;

wherein the one or more leakage ports are positioned so that fluid that leaks past the one or more packing rings will flow through the one or more leakage ports and wherein the packing retainer is configured to be removable from within the pump housing for leakage servicing.

2. The piston rod assembly of claim 1, wherein the packing retainer further comprises a circumferential channel formed in the outer surface of the packing retainer and positioned to be in fluid communication with the one or more leakage ports.

3. The piston rod assembly of claim 1, wherein the piston rod further comprises a second end configured to contact a drive mechanism.

4. The piston rod assembly of claim 1, wherein the one or more packing rings are V-shaped.

5. The piston rod assembly of claim 1 and further comprising a paint permeable ring adjacent the one or more ports at the inner surface of the packing retainer.

6. The piston rod assembly of claim 5, wherein the paint permeable ring is formed of felt or other stranded material.

7. The piston rod assembly of claim 5, wherein the paint permeable ring is a lubrication ring.

8. The piston rod assembly of claim 5, wherein the paint permeable ring is oil-soaked.

9. The piston rod assembly of claim 5, wherein the paint permeable ring includes lateral holes adjacent the one or more leakage ports.

10. The piston rod assembly of claim 1 and further comprising an annular wiper seal adjacent the inner surface of the packing retainer and positioned between the one or more leakage ports and a top end of the packing retainer.

11. The piston rod assembly of claim 10, wherein the one or more leakage ports are located between the annular wiper seal and the one or more packing rings.

12. The piston rod assembly of claim 10, wherein the annular wiper seal includes an O-ring and a U-shaped ring.

13. The piston rod assembly of claim 10 and further comprising:

a paint permeable ring adjacent the one or more leakage ports at the inner surface of the packing retainer;

an annular retainer adjacent the inner surface of the packing retainer and positioned between the annular wiper seal and the paint permeable ring;

a first annular gland adjacent the inner surface of the packing retainer and positioned between the one or more packing rings and the bottom end of the packing retainer;

a second annular gland adjacent the inner surface of the packing retainer and positioned between the paint permeable ring and the one or more packing rings; and a bushing adjacent the inner surface of the packing retainer and positioned between the annular wiper seal and the top end of the packing retainer.

14. The piston rod assembly of claim 1 and further comprising a spring adjacent the bottom end of the packing retainer.

15. A piston pump assembly comprising:

a pump housing including one or more leakage outlets forming passageways between an inner surface and an outer surface of the pump housing and an intake port at a bottom of the pump housing;

a piston rod assembly according to claim 1, wherein the piston rod assembly extends into a top of the pump housing; and an output port connected to the pump housing;

wherein the one or more leakage ports and the one or more leakage outlets are in fluid communication and positioned so that fluid that leaks past the one or more packing rings will flow through the one or more leakage ports and the one or more leakage outlets and down the outer surface of the pump housing.

16. The piston pump assembly of claim 15, further comprising a circumferential channel positioned to connect the one or more leakage outlets and the one or more leakage ports.

17. The piston pump assembly of claim 16, wherein the circumferential channel is formed in the inner surface of the pump housing.

18. A fluid dispensing system comprising:

a frame;

an end bell connected to the frame;

a motor housing connected to the end bell, wherein a motor is mounted within the motor housing;

a front cover connected to the end bell;

a piston pump assembly according to claim 15; wherein the piston pump assembly is capable of mounting on the end bell.

19. The fluid dispensing system of claim 18 and further comprising a yoke, wherein the yoke is shaped to fit a second end of the piston rod.

20. A method for controlling leakage of fluid along a piston rod stem of a piston pump assembly, the method comprising:

directing fluid that has leaked past one or more packing rings in a packing retainer from an inner end of a leakage port in the packing retainer to an outer end of the leakage port, the leakage port being located between the one or more packing rings and a top end of the packing retainer;

guiding the fluid from the outer end of the leakage port to an inner end of a leakage outlet in a pump housing;

wherein the packing retainer is positioned within the pump housing to align the leakage port with the leakage outlet to allow the fluid to flow from the leakage port to the leakage outlet; and wherein the leakage outlet forms a passageway for the fluid to move from an interior of the pump housing to an exterior of the pump housing; and directing the fluid from an inner end of the leakage outlet in the pump housing to an outer end of the leakage outlet, which is positioned so that the fluid will flow down a visible outer surface of the pump housing to provide a visual indication that fluid is leaking, wherein the packing retainer is removable from within the pump housing for leakage servicing.

21. A piston rod assembly comprising:

a piston rod having a first end configured to contact fluid;

a packing retainer though which the piston rod extends, the packing retainer including one or more leakage ports forming passageways between an inner surface and an outer surface of the packing retainer;

one or more packing rings that surround the piston rod, are adjacent the inner surface of the packing retainer, and are positioned between the one or more leakage ports and a bottom end of the packing retainer; and a paint permeable ring adjacent the one or more ports at the inner surface of the packing retainer;

wherein the one or more leakage ports are positioned so that fluid that leaks past the one or more packing rings will flow through the one or more leakage ports.

22. The piston rod assembly of claim 21, wherein the paint permeable ring is formed of felt or other stranded material.

23. The piston rod assembly of claim 21, wherein the paint permeable ring is a lubrication ring.

24. The piston rod assembly of claim 21, wherein the paint permeable ring is oil-soaked.

25. The piston rod assembly of claim 21, wherein the paint permeable ring includes lateral holes adjacent the one or more leakage ports.

26. A piston rod assembly comprising:

a piston rod having a first end configured to contact fluid;

a packing retainer though which the piston rod extends, the packing retainer including one or more leakage ports forming passageways between an inner surface and an outer surface of the packing retainer;

one or more packing rings that surround the piston rod, are adjacent the inner surface of the packing retainer, and are positioned between the one or more leakage ports and a bottom end of the packing retainer;

an annular wiper seal adjacent the inner surface of the packing retainer and positioned between the one or more leakage ports and a top end of the packing retainer;

a paint permeable ring adjacent the one or more leakage ports at the inner surface of the packing retainer;

an annular retainer adjacent the inner surface of the packing retainer and positioned between the annular wiper seal and the paint permeable ring;

a first annular gland adjacent the inner surface of the packing retainer and positioned between the one or more packing rings and the bottom end of the packing retainer;

a second annular gland adjacent the inner surface of the packing retainer and positioned between the paint permeable ring and the one or more packing rings; and a bushing adjacent the inner surface of the packing retainer and positioned between the annular wiper seal and the top end of the packing retainer;

wherein the one or more leakage ports are positioned so that fluid that leaks past the one or more packing rings will flow through the one or more leakage ports.

27. The piston rod assembly of claim 26, wherein the one or more leakage ports are located between the annular wiper seal and the one or more packing rings.

28. The piston rod assembly of claim 26, wherein the annular wiper seal includes an O-ring and a U-shaped ring.

* * * * *